US009091511B2

(12) United States Patent
Shmargad

(10) Patent No.: US 9,091,511 B2
(45) Date of Patent: Jul. 28, 2015

(54) COMMON MOUNTING PROVISIONS FOR AN ARMORED VEHICLE

(75) Inventor: Amikam Shmargad, Foster City, CA (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 250 days.

(21) Appl. No.: 13/608,753

(22) Filed: Sep. 10, 2012

(65) Prior Publication Data

US 2013/0062486 A1 Mar. 14, 2013

Related U.S. Application Data

(60) Provisional application No. 61/532,645, filed on Sep. 9, 2011.

(51) Int. Cl.
*F41H 7/02* (2006.01)
*F41H 7/04* (2006.01)
*F41H 5/013* (2006.01)

(52) U.S. Cl.
CPC ..... *F41H 7/044* (2013.01); *F41H 5/013* (2013.01)

(58) Field of Classification Search
USPC ..... 89/36.08, 36.09, 36.01, 36.02, 36.04
See application file for complete search history.

(56) References Cited

U.S. PATENT DOCUMENTS 1,273,515 A * 7/1918 Makrenos ..... 109/81
4,398,446 A * 8/1983 Pagano et al. ..... 89/36.08
H000129 H * 9/1986 Hansen
4,716,810 A 1/1988 DeGuvera
5,033,357 A 7/1991 Seksaria et al.
5,170,690 A * 12/1992 Smirlock et al. ..... 89/36.08
5,398,592 A * 3/1995 Turner ..... 89/36.08
5,499,568 A * 3/1996 Turner ..... 89/36.08
5,663,520 A * 9/1997 Ladika et al. ..... 296/187.07
5,670,734 A * 9/1997 Middione et al. ..... 89/36.08
5,679,918 A * 10/1997 Korpi et al. ..... 89/36.08
6,082,240 A * 7/2000 Middione et al. ..... 89/36.08
6,848,372 B2 * 2/2005 Alizade ..... 109/78
6,962,102 B1 11/2005 Johnston et al.
7,458,306 B2 * 12/2008 Singh et al. ..... 89/36.02
7,882,776 B2 2/2011 Medwell et al.

(Continued)

OTHER PUBLICATIONS

International Search Report and Written Opinion from PCT Application PCT/US2012/054467, dated May 29, 2013, 12 pgs.

(Continued)

*Primary Examiner* — Benjamin P Lee
(74) *Attorney, Agent, or Firm* — Patterson Thuente Pedersen, P.A.

(57) ABSTRACT

Apparatus and related methods of utilizing a common mounting provision within an armored vehicle. The common mounting provision includes a plurality of common mounting bosses that are arranged in a grid type pattern formed by attaching a plurality of mounting bars to an interior wall of an armored hull with each mounting bar including at least one of the common mounting bosses. The grid type pattern provides for a common spatial distance between adjacent apertures in rows and columns. When engineering changes are needed, the grid type pattern provides the engineer with known mounting bosses having a known spacing allowing the engineer to readily design the component to attach to the common mounting provision. By knowing the size and location of each mounting boss, the engineer will spend less time designing and fitting new components and will avoid having to continually update drawings to illustrate new mounting provisions.

11 Claims, 11 Drawing Sheets

(56) References Cited

U.S. PATENT DOCUMENTS

| | | | | |
|---|---|---|---|---|
| 8,151,686 | B2 * | 4/2012 | Ravid et al. | 89/36.02 |
| 8,480,150 | B2 * | 7/2013 | Medwell et al. | 296/29 |
| 8,757,042 | B2 * | 6/2014 | Pfister | 89/36.07 |
| 2005/0257677 | A1 * | 11/2005 | Ravid et al. | 89/36.02 |
| 2006/0213360 | A1 * | 9/2006 | Ravid et al. | 89/36.01 |
| 2007/0234895 | A1 * | 10/2007 | Singh et al. | 89/36.07 |
| 2008/0257141 | A1 * | 10/2008 | Medwell et al. | 89/36.02 |
| 2010/0147142 | A1 * | 6/2010 | Hall | 89/36.02 |
| 2011/0030543 | A1 * | 2/2011 | Ravid et al. | 89/36.02 |
| 2011/0072960 | A1 | 3/2011 | Hallissy et al. | |
| 2012/0097018 | A1 * | 4/2012 | Schoenheit et al. | 89/36.02 |
| 2013/0180393 | A1 * | 7/2013 | Kienzle et al. | 89/36.02 |
| 2014/0007762 | A1 * | 1/2014 | Gavish et al. | 89/36.02 |

OTHER PUBLICATIONS

International Preliminary Report on Patentability from related PCT Application PCT/US2012/054467, dated Mar. 20, 2014, 9 pgs.

* cited by examiner

COMMON MOUNTING PROVISIONS FOR AN ARMORED VEHICLE

RELATED APPLICATION

The present application claims the benefit of U.S. Provisional Application No. 61/532,645, filed Sep. 9, 2011 and entitled "COMMON MOUNTING PROVISIONS FOR AN ARMORED VEHICLE", which is incorporated herein by reference in its entirety.

FIELD OF THE INVENTION

The present invention relates to armored vehicles. More particularly, the present invention relates to a mounting system to aid in the design and retrofit of new devices that are mounted to an interior wall of a vehicle hull.

BACKGROUND OF INVENTION

Protecting occupants of vehicles in combat areas is increasingly challenging due to constantly evolving threats and the ingenuity of combatants. Combat and tactical vehicles are often provided with various internal components to assist occupants. Over time, these internal components may become damaged or rendered obsolete in a changing threat environment. In these situations, components may need to be designed to retrofit a vehicle with new equipment. Due to ever evolving technology and revision levels for equipment such as, for example, the Bradley Fighting Vehicle, components may need to be designed from scratch or even individually designed for specific models such that the components can be safely and securely mounted within the vehicle. Custom or one off designs add significant time and cost to projects that can be an impediment to providing soldiers with the most up to date and combat effective vehicle.

With current armored vehicles, internal mounting locations can be specific to both a particular variant of the armored vehicle as well as the type of equipment being installed. In addition, the internal mounting locations can have specific sizes that correspond to certain types of equipment to be installed or alternatively, the internal mounting locations can be a hodgepodge of different sizes and connection styles.

In view of the current costs associated with retrofitting armored vehicles, it would be advantageous to utilize a component mounting system that reduced the overall investment in engineering and labor to accomplish a retrofit.

SUMMARY OF INVENTION

The present invention is directed to a component mounting system for an interior of a vehicle hull that utilizes a common mounting provision to assist in the design and replacement of internal components. For example, incorporating a component mounting system of the present invention into the Bradley fighting vehicle by changing the current mounting provisions to a "common mounting provision" allows for engineering changes and the installation of the present equipment to be completed with less complexity and a reduced cost. In addition, the use of the common mounting provision allows for similar engineering changes to be simultaneously performed across the different variants of the Bradley such that costs are reduced even further. The common mounting provision can provide for a "peg board" type design that has common fitting sizes and spatial dimension across the entire vehicle or alternatively, across an interior wall of vehicle hull. The peg board can include dimensionally standardized rows and columns of mounting bosses arranged a grid pattern across the vehicle or vehicle wall such that designs can be quickly created with a high level of confidence that that components will align, fit and mount properly within the vehicle because the grid pattern of the mounting bosses will be consistent within the vehicle and across vehicle variants. Not only will the component mounting system of the present invention reduce the amount of engineering time needed to design parts, but mounting provisions will need to be updated much less frequently and the armored vehicles will be much more versatile.

In one aspect, the present invention is directed to a common mounting provision for an armored vehicle. The common mounting provision comprises a plurality of mounting bosses that are arranged in a grid type pattern. Generally, this grid type pattern comprises both rows and columns of mounting bosses having a common spatial distance between adjacent boss apertures in the rows and columns. When engineering changes are needed, and new equipment required, the grid type pattern provides the engineer with known common boss apertures that possess a known spacing allowing the engineer to readily design the component to fit the new common mounting location. By knowing the size and location of each mounting boss, the engineer will spend less time designing and fitting the new component and will also not have to continually update drawings to illustrate new mounting provisions. In one embodiment, the common mounting provision can be adapted to the Bradley Family of Vehicles allowing retrofits to be accomplished faster and with less cost than previously done. In addition, the common mounting provision can be accomplished across the different variants of the Bradley Family of Vehicles such that separate engineering and fabrication is avoided for the different variants. The common mounting provisions can find application in any of a variety of wheeled and/or tracked armored vehicles that are subject to retrofits and updates due to changing battlefield conditions.

In another aspect, the present invention is directed to a method for retrofitting an armored vehicle. The method can comprise providing a common mounting provision on an interior wall of an armored hull including the positioning of a plurality of mounting bosses in a grid pattern. The method can further include designing a replacement component layout based upon the grid pattern. The method can further include attaching the replacement component to at least one of the mounting bosses. In some embodiments, the method can comprise attaching a plurality of mounting bars to individual plates defining the common mounting provision, wherein each mounting bar includes at least one mounting boss. In some embodiments, the method can comprise establishing a common distance between mounting bosses that are arranged adjacently in the grid pattern, both for horizontal rows and vertical columns of the grid pattern.

In yet another aspect of the present invention, an armored vehicle can comprise an armored hull including an interior wall. The interior wall can include a common mounting provision comprising a plurality of mounting bosses arranged in a grid pattern, wherein each mounting boss shares a common boss aperture for receiving a common mounting connector. A plurality of mounting bars can be attached to plates defining the common mounting provision, wherein each mounting bar includes at least one mounting boss defined therein. The common mounting provision can establish common distances between mounting boss that are located adjacently in the grid pattern, in both horizontal rows and vertical columns.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be more completely understood in consideration of the following detailed description of various embodiments of the invention in connection with the accompanying drawings, in which.

Figure 1:
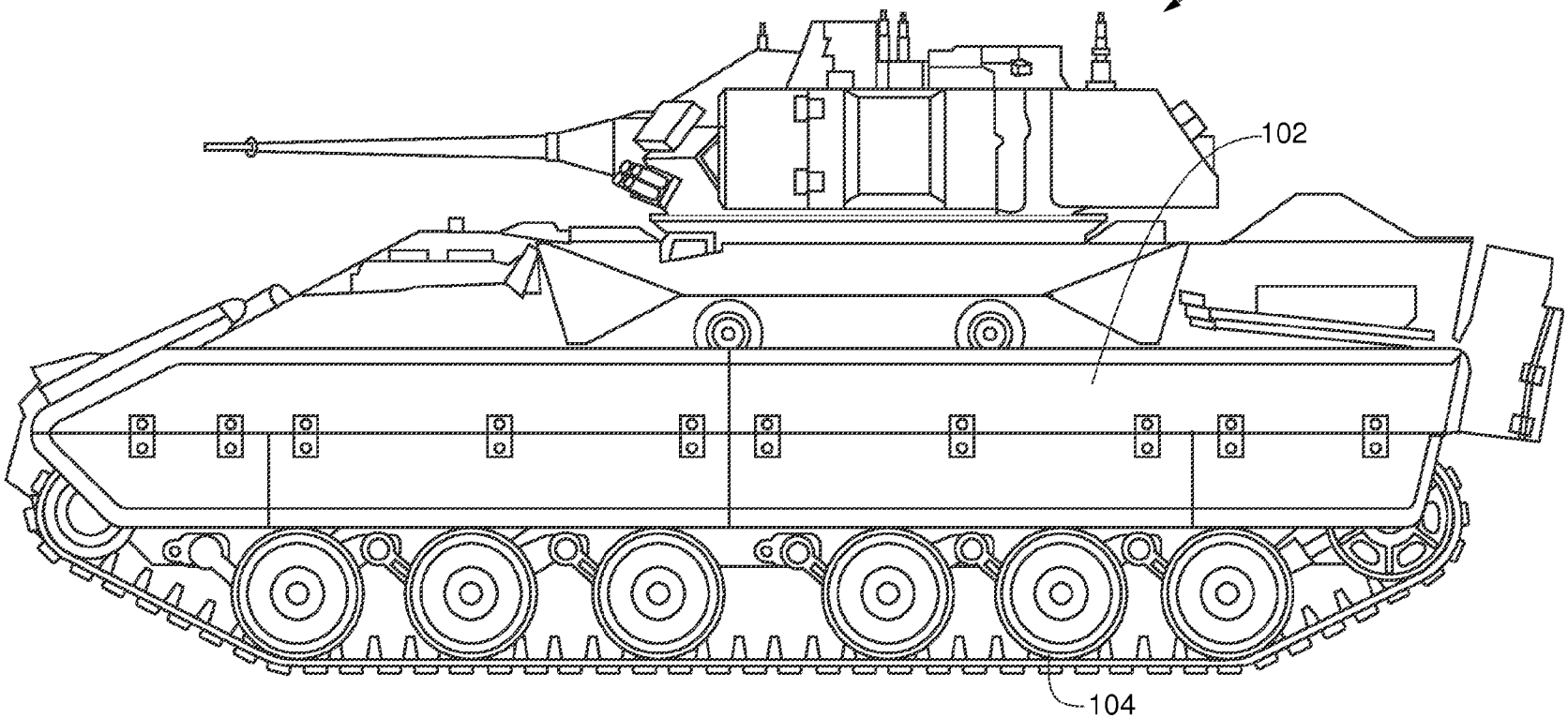
FIG. 1 is a side view of an armored vehicle according to the prior art.

While the invention is amenable to various modifications and alternative forms, specifics thereof have been shown by way of example in the drawings and will be described in detail. It should be understood, however, that the intention is not to limit the invention to the particular embodiments as described. On the contrary, the intention is to cover all modifications, equivalents, and alternatives falling within the spirit and scope of the invention as defined by the appended claims.

DETAILED DESCRIPTIONS OF THE DRAWINGS

Referring generally to FIG. 1, an armored vehicle 100 of the present invention can comprise an armored hull 102 coupled to a traction system 104. Traction system 104 can comprise a track-based and/or wheel based system allowing the armored vehicle to reliable traverse terrain on a battlefield. For purposes of describing the present invention, armored vehicle is described and illustrated as being a Bradley Fighting Vehicle though it will be easily understood to one of ordinary skill in the art that the invention can be similarly applied to other armored vehicles including tanks, personnel carriers, anti-aircraft vehicles and self-propelled artillery.

Figure 2:
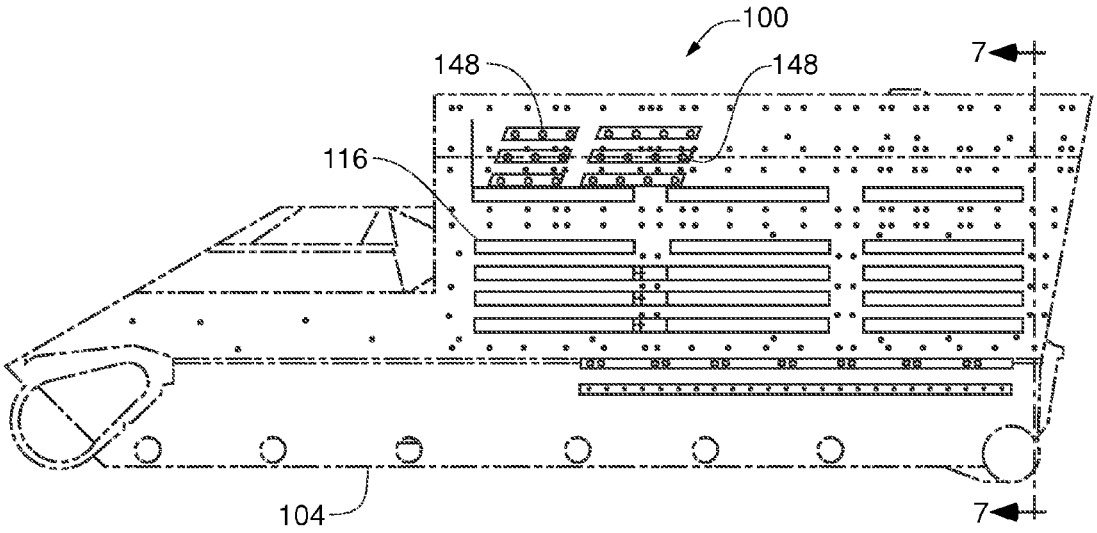
FIG. 2 is a partially hidden, side view of an armored vehicle including a common mounting provision of the present invention.
Figure 3:
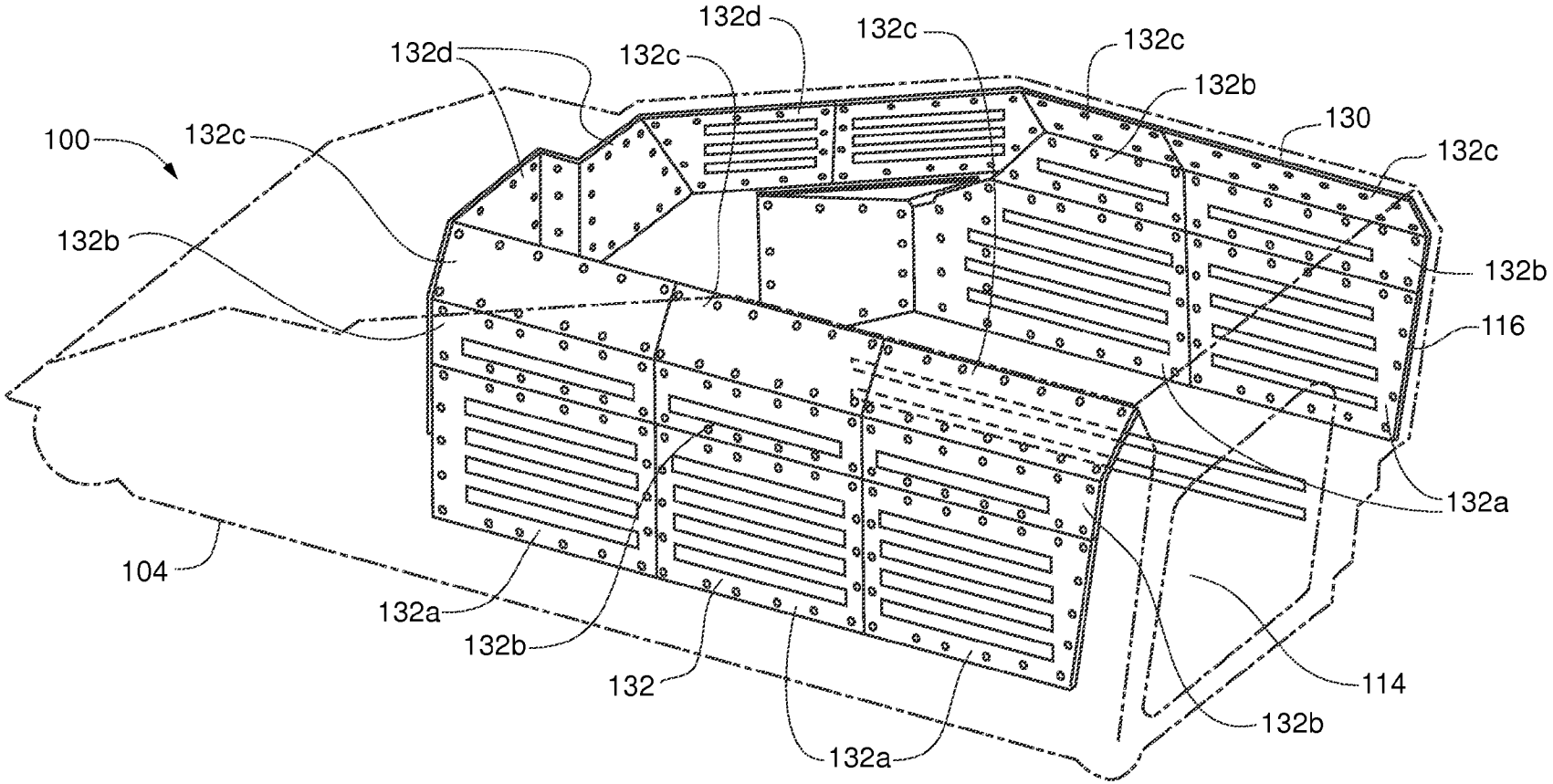
FIG. 3 is a partially hidden, perspective view of the armored vehicle of FIG. 2.
Figure 4:
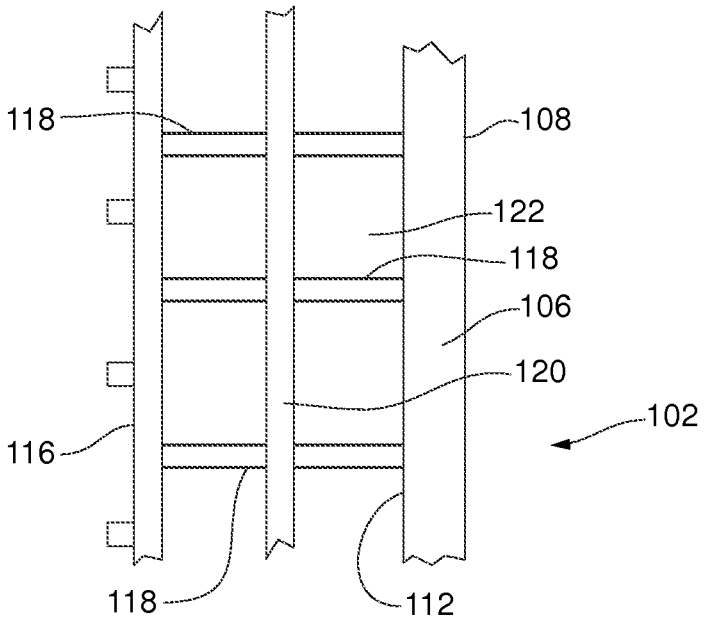
FIG. 4 is a section view of a vehicle hull taken at section 4-4 of FIG. 7 according to an embodiment of the present invention.

Referring to FIGS. 2, 3 and 4, the armored hull 102 generally comprises a hull wall 106 having an exterior surface 108 to which armor is mounted. Hull wall 106 further includes an interior surface 112 in which an occupant space 114 is defined. A common mounting provision 116 is attached to the interior surface 112 using one or more mounting members 118. In order to provide an additional level of protection to the occupants of the armored vehicle 100, a spall liner 120 is mounted between the interior surface 112 and the common mounting provision 116. In some embodiments, mounting member 118 can be used to mount both the spall liner 120 and the common mounting provision 116. In the event that a munition type projectile strikes and/or penetrates the armor 110 and hull wall 106 of the armored vehicle 100, an extremely dangerous situation can be created by flying metallic debris, referred to as spall, resulting from ballistic damage as the projectile penetrates the armored hull 102. Spall liner 120 is installed adjacent to the interior surface 112 of the hull wall 106 to suppress and/or control the spall. It is desirable to maintain a gap between the inner surface of the wall of the vehicle and the spall liner. In a preferred embodiment, mounting member 118 provides for a spall gap 122 to be created between the interior surface 112 and spall liner 120 such that the flight characteristics of the spall experience advantageous changes prior to striking the spall liner 120. Spall liner 120 is generally fabricated of a balistically resilient material or web such as, for example, Kevlar® so as to provide maximum possible protection to occupants of the armored hull 102. With the use of mounting member 118, common mounting provision 116 can be coupled to the interior surface 112 without hampering or otherwise interfering with the spaced relationship of the spall liner 120 relative to the interior surface 112 of the hull wall 106.

Figure 5:
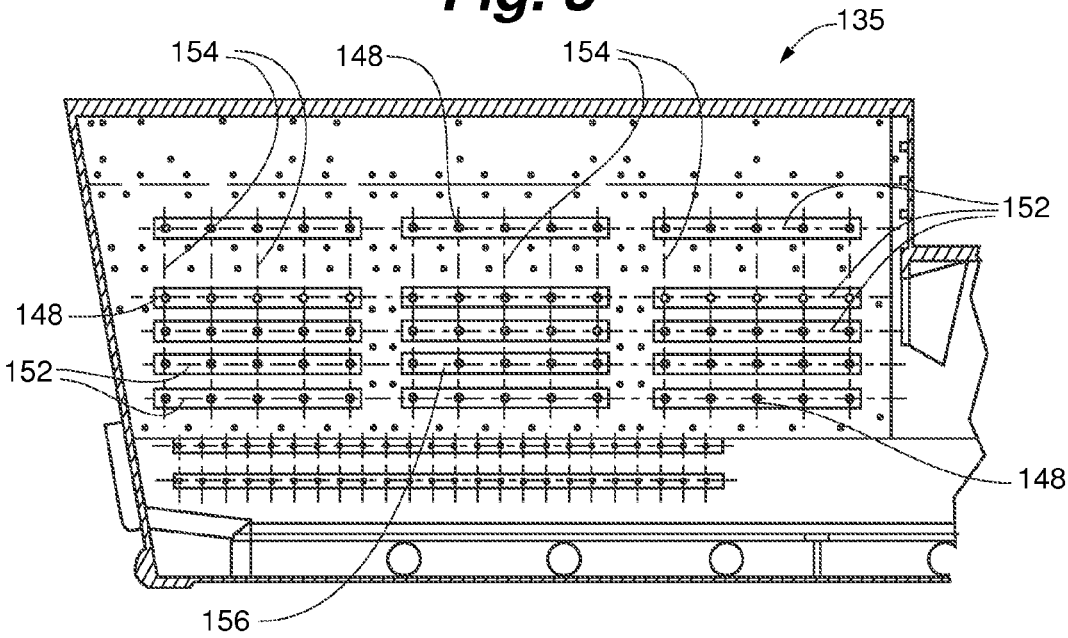
FIG. 5 is a side view of a left side wall taken at section 5-5 of FIG. 7 according to an embodiment of the present invention.
Figure 6:
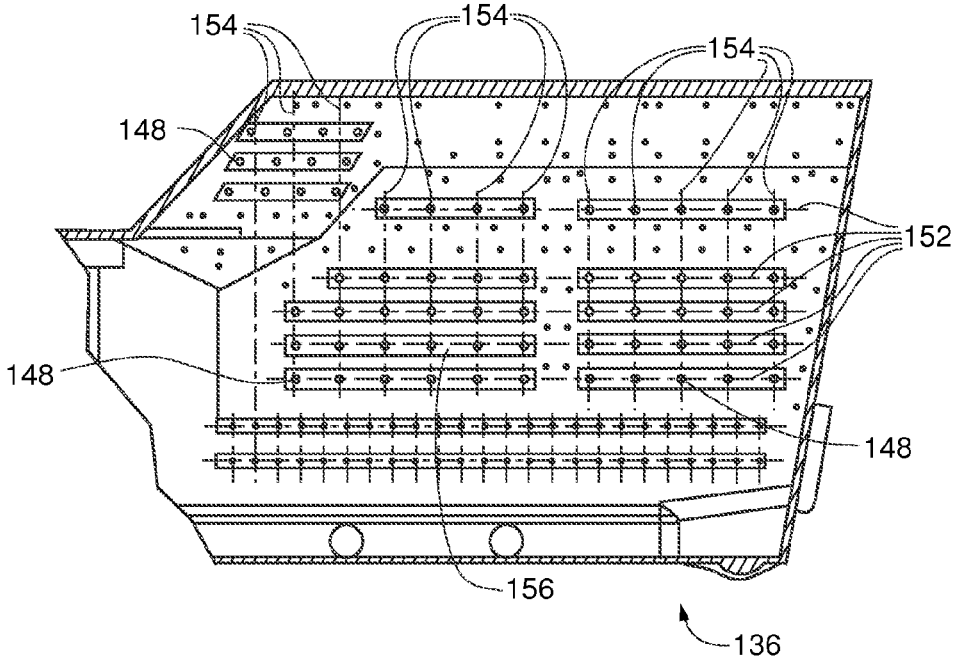
FIG. 6 is a side view of a right side wall taken at section 6-6 of FIG. 7 according to an embodiment of the present invention.
Figure 5A:
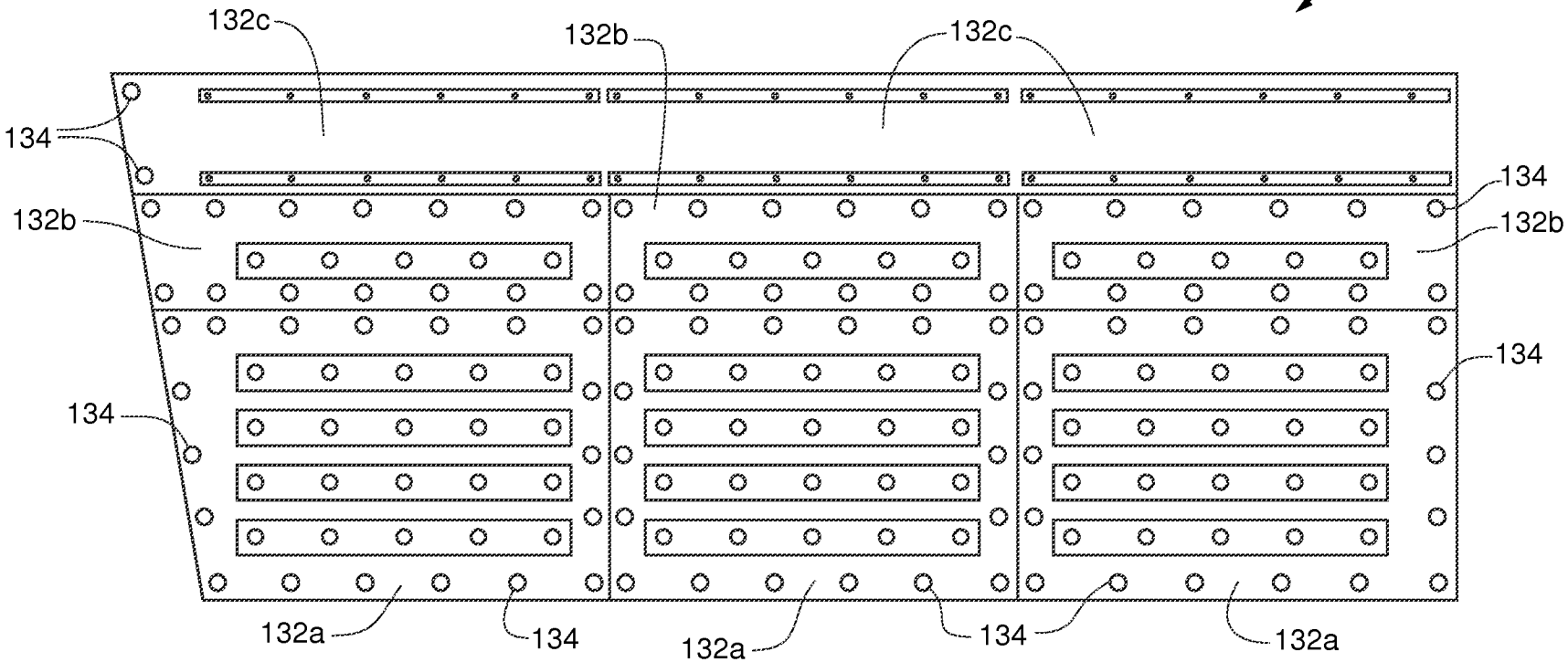
FIG. 5*a* is a side view of the left side wall of FIG. 5.
Figure 6A:
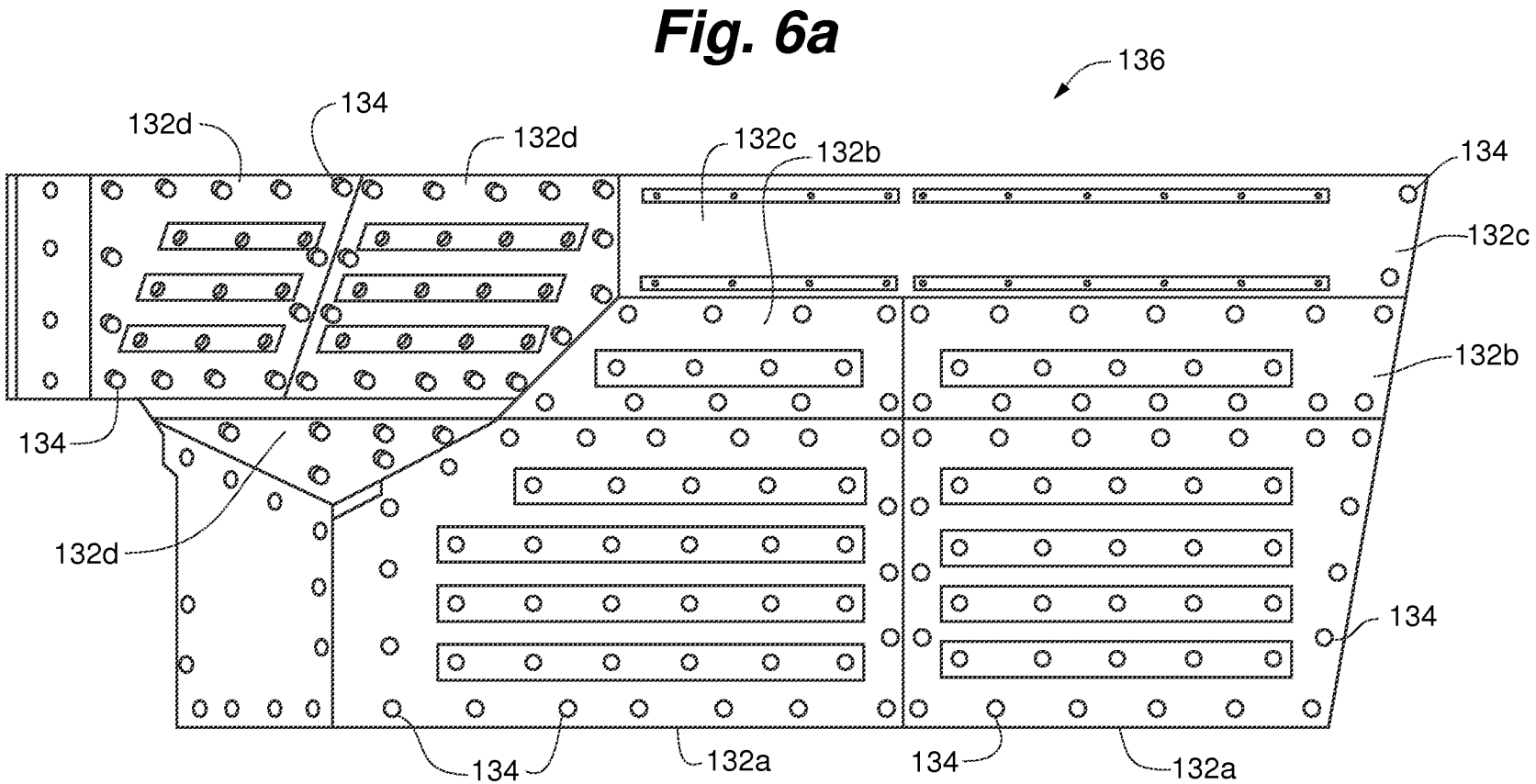
FIG. 6*a* is a side view of the right side wail of FIG. 6.
Figure 7:
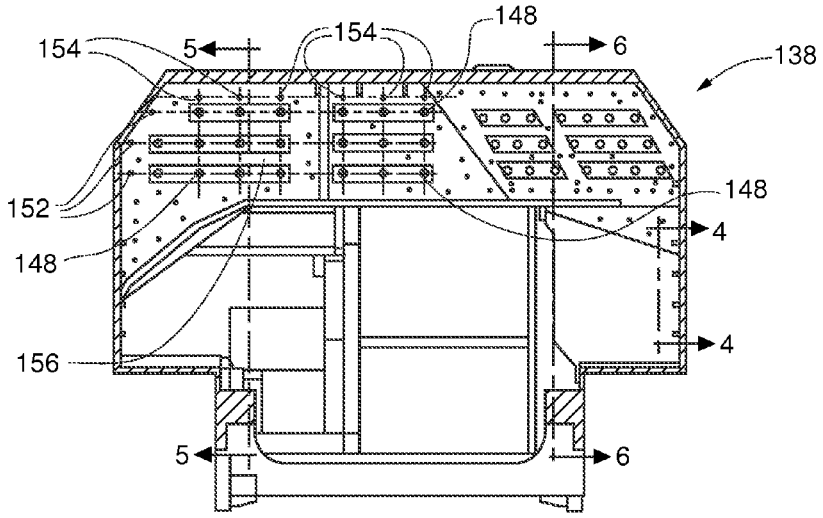
FIG. 7 is a side view of a front wall taken at section 7-7 of FIG. 2 according to an embodiment of the present invention.
Figure 7A:
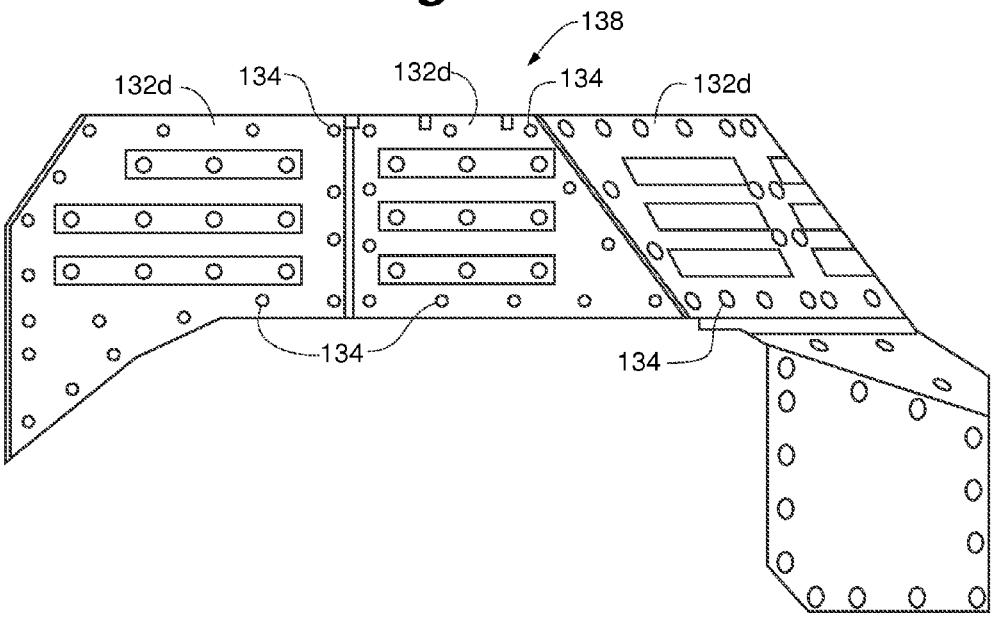
FIG. 7*a* is a side view of the front wall of FIG. 7.
Figure 8A:
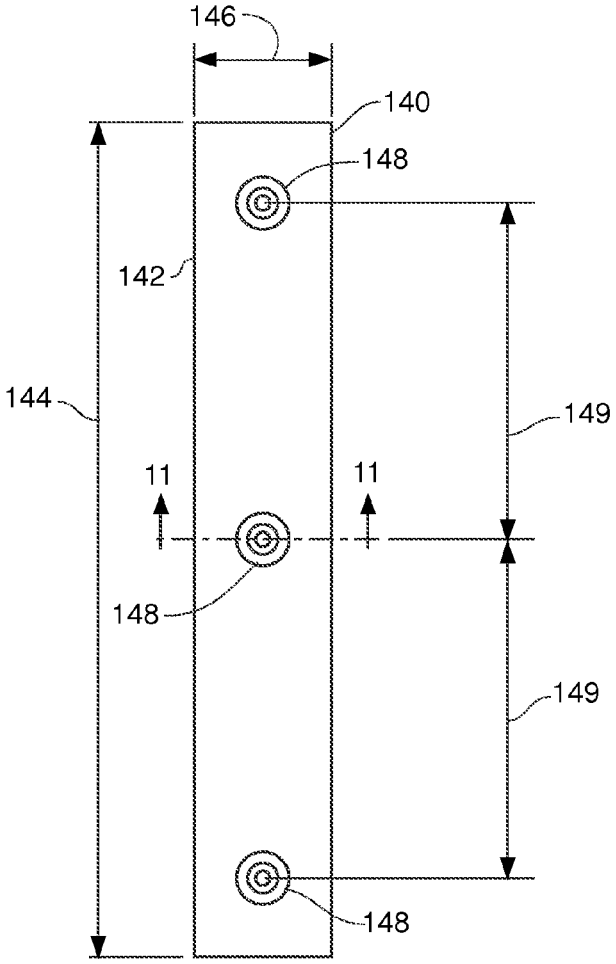
FIG. 8*a* is a front view of a mounting bar having three mounting bosses according to an embodiment of the present invention.
Figure 8B:
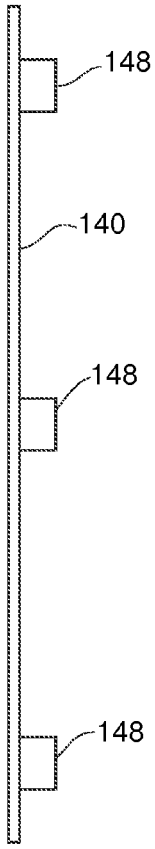
FIG. 8*b* is a side view of the mounting bar of FIG. 8*a*.
Figure 8C:
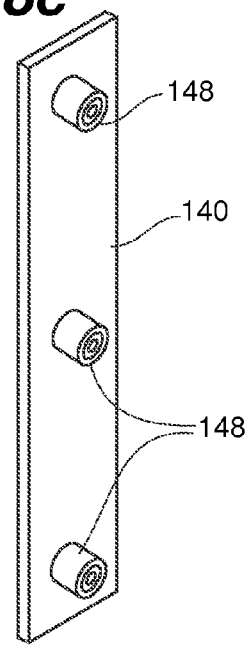
FIG. 8*c* is a perspective view of the mounting bar of FIG. 8*a*.

With reference to FIGS. 2 and 3, hull wall 106, armor 110, mounting members 118 and spall liner 120 have been removed so as to illustrate common mounting provision 116 in an installed configuration 130 surrounding occupant space 114. As illustrated, common mounting provision 116 comprises a plurality of individual plates 132 arranged so as to effectively mimic and cover the hull wall 106. Individual plates 132 can comprise various plate designs such as, for example, side wall plates 132*a*, sponson plates 132*b* and sloped wall plates 132*c*. Depending upon hull configurations, a variety of customized plates 132*d* can also be used to accommodate features that are specific to certain battlefield roles. Various combinations of side wall plates 132*a*, sponson plates 132*b* and sloped wall plates 132*c* and customized wall plates 132*d* can be used to define a left side 135 as shown in FIGS. 5 and 5*a*, a right side 136 as shown in FIGS. 6 and 6*a* and a front end 138 as shown in FIGS. 7 and 7*a*. Plates 132 generally include a plurality of fastening apertures 134 that allow the plates 132 to be coupled to the interior surface 112 of hull wall 106 using mounting members 118.

Figure 11:
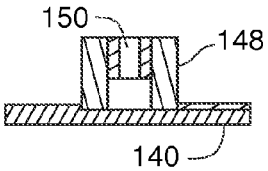
FIG. 11 is a section view of a mounting boss taken at section 11-11 of FIG. 8*a* according to an embodiment of the present invention.
Figure 9A:
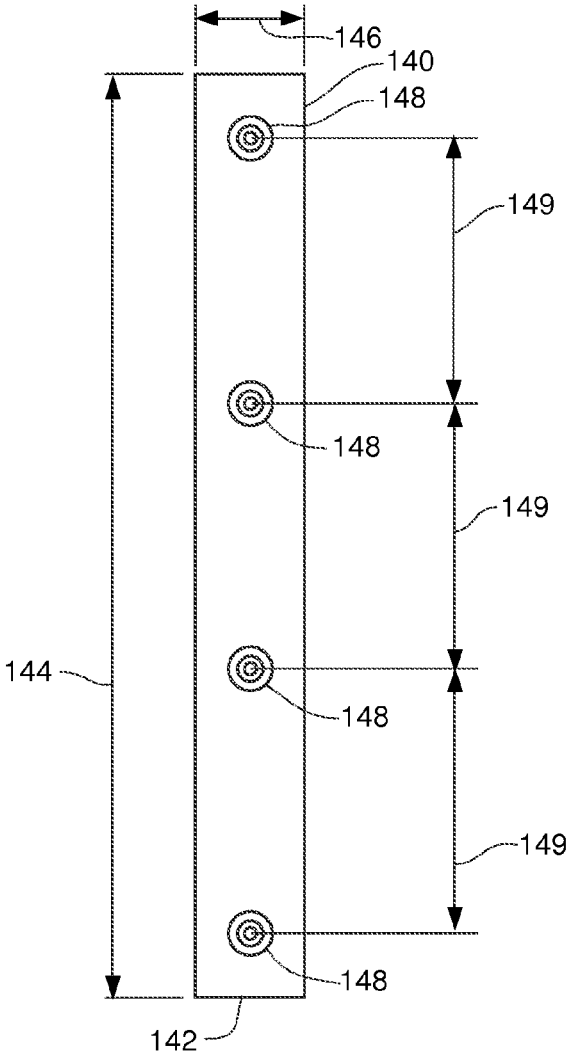
FIG. 9*a* is a front view of a mounting bar having four mounting bosses according to an embodiment of the present invention.
Figure 9B:
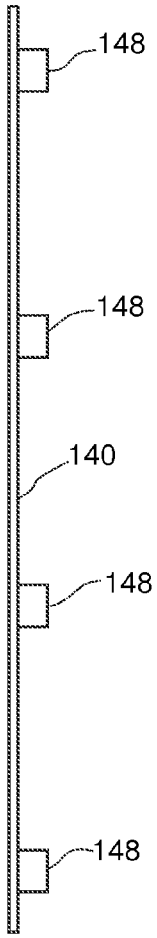
FIG. 9*b* is a side view of the mounting bar of FIG. 9*a*.
Figure 9C:
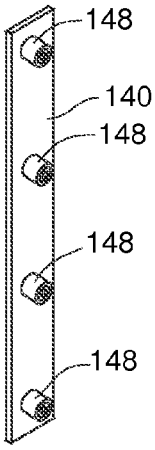
FIG. 9*c* is a perspective view of the mounting bar of FIG. 9*a*.
Figure 10A:
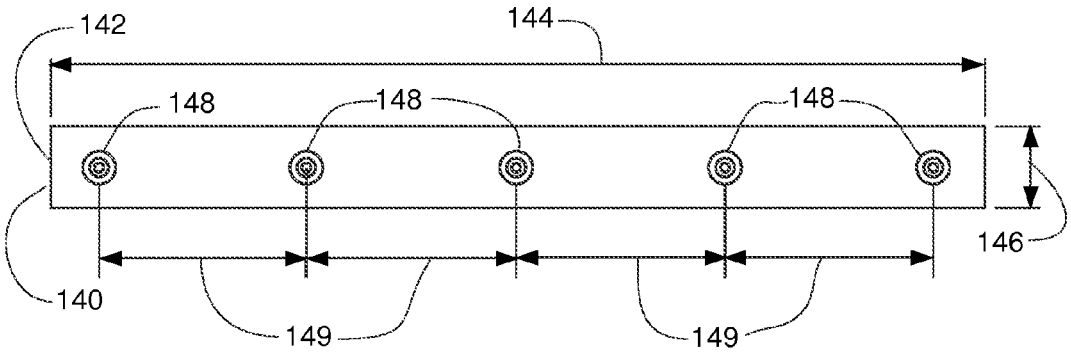
FIG. 10*a* is a front view of a mounting bar having five mounting bosses according to an embodiment of the present invention.
Figure 10B:
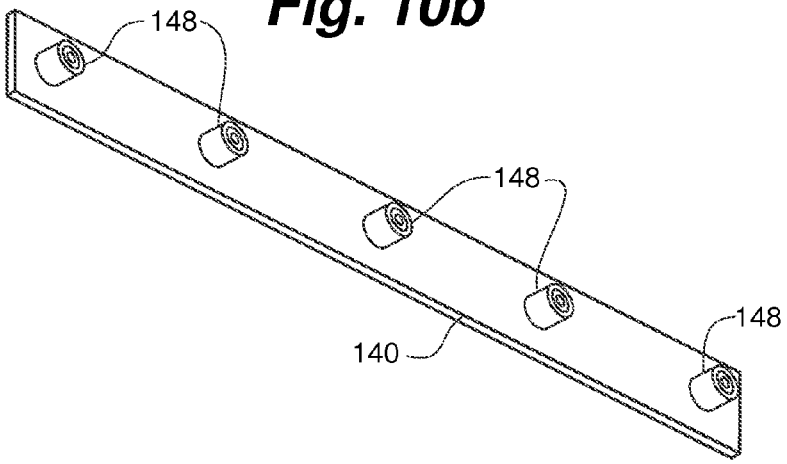
FIG. 10*b* is a perspective view of the mounting bar of FIG. 10*a*.

Each of the individual plates 132 can comprise one or more plate bars 140 operably coupled to the plate 132. Each plate bar 140 can have a generally rectangular perimeter 142 defined by a bar length 144 and a bar width 146 as illustrated in FIGS. 8*a*, 8*b*, 8*c*, 9*a*, 9*b*, 9*c*, 10*a* and 10*b*. Each plate bar 140 can comprise one or more projecting bosses 148. Projecting bosses 148 can be attached to the plate bar 140 using suitable connection methods such as, for example, by welding the projecting bosses 148 to the plate bar 140. Depending upon the style of plate 132, for example, side wall plates 132*a*, sponson plates 132*b*, sloped wall plates 132*c* or customized wall plates 132*d*, to which the plate bar 140 is attached or even where on the plate 132 that the plate bar 140 is to be attached, plate bar 140 can have a variety of plate lengths 144 and correspondingly, a variety of projecting bosses 148. For example, side wall plates 132*a* can comprise four plate bars 140 having either four or five projecting bosses 148 as shown in FIGS. 5*a* and 6*a* depending upon which side of the occupant space 114 the side wall plate 132*a* is positioned. Similarly, sponson plates 132*b*, sloped wall plates 132*c* and customized wall plates 132*d* can comprise one or more plate bars 140 of varying plate lengths 144 having one or more projecting bosses 148, for example, three projecting bosses 148 as shown in FIGS. 6*a* and 7*a*. Regardless of how many projecting bosses 148 are attached to the plate bar 140 or to which plate 132 the plate bar 140 is to be attached, a center to center boss spacing distance 149 is maintained. Projecting boss 148 generally defines a common boss aperture 150 as shown in FIG. 11 such that regardless of the size of the plate bar 140 or which plate 132 the plate bar 140 is mounted, an engineer will know with certainty the type of common mounting connector that can be used to connect new componentry to the common mounting provision 116. For example, common boss aperture 150 can comprise a threaded aperture capable of receiving a ⅜" NPT bolt.

In attaching the plate bars 140 to the various plates 132, plate bars 140 are spaced apart and positioned such that the projecting bosses 148 are not only aligned along an x-axis 152 defined along the bar length 144 but also along a y-axis 154 relative to adjacently positioned plate bars 140 as shown in FIGS. 5, 6 and 7. As illustrated, plate bars 140 are shown attached along x-axis 152 though it is to be understood that the plate bars 140 could be similarly attached along y-axis 154 without departing from the scope and spirit of the present invention. When the plate bars 140 are attached as illustrated in FIGS. 5, 6 and 7, the projecting bosses 148 define a grid pattern 156 or "peg-board" wherein distances between adjacent projecting bosses 148 along both the rows defined by the x-axis 152 and columns of the y-axis 154 are fixed and consistent between the various panels 132. By providing the consistent grid-pattern 156 of projecting bosses 148, the engineer can be assured that components will fit and properly attach to the common mounting provision 116. In certain locations, for example, on sloped wall plates 132*c*, footman loops can be mounted between adjacent projecting bosses 148 that are not otherwise being utilized for component mounting such that grasping or hanging points can be provided to occupants. It will be understood that a wide variety of other accessories could be attached to unoccupied projecting bosses 148 that are not utilized for component mounting in the armored vehicles present configuration.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

What is claimed is:

1. An armored vehicle, comprising:

an armored hull including an interior wall, the a mounting provision attached to the interior wall by a plurality of mounting members, the mounting provision including a plurality of mounting bosses arranged in a grid pattern on the interior face of the mounting provision, each mounting boss having a boss aperture for receiving a mounting connector and wherein a spall liner is positioned between the interior wall and the armored hull, and wherein a spall gap is positioned between the armored hull and the spall liner.

2. The armored vehicle of claim 1, wherein the mounting provision is defined by attachment of a plurality of plates to the interior wall the plates arranged to cover the interior armored hull wall, each plate including at least one of the mounting bosses.

3. The armored vehicle of claim 2, wherein the at least one mounting boss is attached to a mounting bar, and wherein the mounting bar is attached to the plate.

4. The armored vehicle of claim 3, wherein the mounting bar is welded to the plate.

5. The armored vehicle of claim 2, wherein the grid pattern establishes a common distance between adjacent mounting bosses along a mounting bar axis defined by adjacently positioned mounting bars.

6. The armored vehicle of claim 1, wherein the grid pattern establishes a common x-axis distance between adjacent mounting apertures in a horizontal row of the grid pattern.

7. The armored vehicle of claim 1, wherein the grid pattern establishes a common y-axis distance between adjacent mounting bosses in a vertical column of the grid pattern.

8. A mounting system for an interior wall of an armored vehicle, comprising:

a mounting provision attached to an interior wall by a plurality of mounting members, the mounting provision including a plurality of mounting bosses so as to define a grid pattern of mounting bosses on the interior face of the mounting provision within a vehicle hull, each mounting boss having a boss aperture for accepting a mounting connector and wherein a spall liner is positioned between the interior wall and the armored hull, and wherein a spall gap is positioned between the armored hull and the spall liner.

9. The mounting system of claim 8, wherein the grid pattern establishes a common distance between adjacent mounting bosses along an axis defined by adjacently positioned mounting bosses.

10. The mounting system of claim 8, wherein the grid pattern establishes a common x-axis distance between adjacent mounting bosses in a horizontal row of the grid pattern.

11. The mounting system of claim 8, wherein the grid pattern establishes a common y-axis distance between adjacent mounting bosses in a vertical column of the grid pattern.

* * * * *

UNITED STATES PATENT AND TRADEMARK OFFICE

CERTIFICATE OF CORRECTION

PATENT NO. : 9,091,511 B2
APPLICATION NO. : 13/608753
DATED : July 28, 2015
INVENTOR(S) : Amikam Shmargad It is certified that error appears in the above-identified patent and that said Letters Patent is hereby corrected as shown below:

In the specification

Column 1, line 58:
Delete "the present" and insert --new--.

Column 3, line 30:
Delete "wail" and insert --wall--.

In the claims

Column 6, line 8:
Delete "the" and insert --with--.

Signed and Sealed this
Seventh Day of June, 2016

Michelle K. Lee

Michelle K. Lee
*Director of the United States Patent and Trademark Office*